US006671385B2

(12) United States Patent
Suzuki et al.

(10) Patent No.: US 6,671,385 B2
(45) Date of Patent: Dec. 30, 2003

(54) SPEAKER AND MAGNETIC CIRCUIT USED FOR THE SPEAKER

(75) Inventors: Takashi Suzuki, Mie (JP); Satoshi Koura, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/111,301

(22) PCT Filed: Aug. 24, 2001

(86) PCT No.: PCT/JP01/07268

§ 371 (c)(1),
(2), (4) Date: Aug. 20, 2002

(87) PCT Pub. No.: WO02/17676

PCT Pub. Date: Feb. 28, 2002

(65) Prior Publication Data

US 2003/0031338 A1 Feb. 13, 2003

(51) Int. Cl.[7] ..... H04R 25/00

(52) U.S. Cl. ..... 381/412; 381/421; 381/422; 381/401

(58) Field of Search ..... 381/396, 412, 381/414, 419, 420, 421, 422, 400, 401, 402

(56) References Cited

U.S. PATENT DOCUMENTS 4,492,827 A * 1/1985 Shintaku ..... 381/422

5,461,677 A * 10/1995 Raj et al. ..... 381/421

FOREIGN PATENT DOCUMENTS

| | | |
|---|---|---|
| JP | 9-55996 | 2/1997 |
| JP | 11-331984 | 11/1999 |

* cited by examiner

*Primary Examiner*—Huyen Le
(74) *Attorney, Agent, or Firm*—Wenderoth, Lind & Ponack, L.L.P.

(57) ABSTRACT

A loudspeaker includes a magnetic circuit comprising a center plate, first and second magnets disposed respectively on a lower surface and an upper surface of the center plate and magnetized to be repulsive to each other, an under plate disposed at a lower surface of the first magnet, and a yoke. The loudspeaker further comprises a voice coil, a diaphragm, an edge coupled with the outer circumferential edge of the diaphragm, and a frame. The above-described magnetic circuit further comprises a top plate disposed on an upper surface of the second magnet. Both of the second magnet and the top plate have a ring shape, the inner and the outer diameters of the second magnet and the top plate being substantially the same. Outer diameters of the second magnet and the top plate are smaller than that of the center plate, and the center plate is provided on its upper surface with a protrusion for positioning of the second magnet. A compact loudspeaker having a sufficient driving force can be provided in accordance with the present invention.

15 Claims, 6 Drawing Sheets

FIG.6 - PRIOR ART
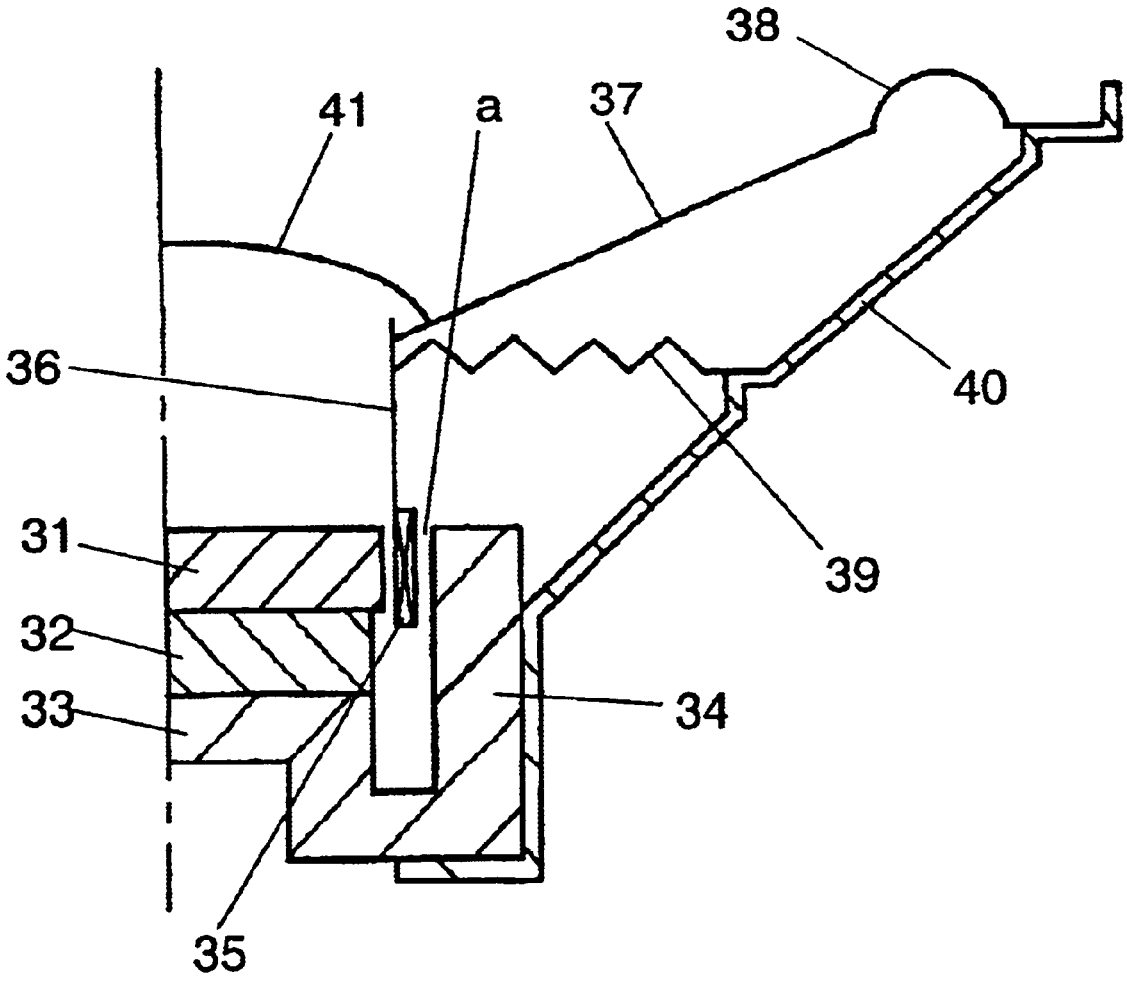

SPEAKER AND MAGNETIC CIRCUIT USED FOR THE SPEAKER

TECHNICAL FIELD

The present invention relates to an electrodynamic loudspeaker (speaker) and a magnetic circuit used for the speaker.

BACKGROUND ART

It is desirable for some acoustic apparatus to be very compact in size, and likewise, for speakers to be used in such apparatus to be compact and light in weight. Downsizing of the magnetic circuit is an effective approach for making the speakers small and light. So, magnets of Nd—Fe—B system, which having a high energy product, have been increasingly used in the speakers. Since the Nd—Fe—B system magnet is an expensive item, the magnetic circuit is required to have high efficiency. Meanwhile, when we look to the field of car-borne sound apparatus, among other fields, a full-range speaker which can reproduce sounds for the entire audible range is popularly used.

Now, a conventional speaker is described referring to FIG. 6.

The conventional speaker comprises a top plate 31, a magnet 32 disposed on an under plate 33 and vertically magnetized, a yoke 34, a voice coil 35 wound around a voice coil bobbin 36, a diaphragm 37, an edge 38, a damper 39, a frame 40, and a dust cap 41. There is a magnetic gap "a" formed between the outer circumferential surface of the top plate 31 and the inner circumferential surface of the yoke 34, and the voice coil 35 is kept in the magnetic gap "a".

It is generally said, regarding the structure of magnetic circuits, that an inner magnet type circuit, for which a magnet 32 is disposed inside, has a higher efficiency; hence the inner magnet structure is advantageous in making a speaker compact and light in weight. However, in order to implement a high-efficiency magnetic circuit with the inner magnet structure, the diameter of the magnet 32 should be equal to that of the top plate 31 so that the magnetic flux coming from magnet 32 is directed only for the magnetic gap "a".

Furthermore, the gross weight of a vibrating system comprising a voice coil 35, a voice coil bobbin 36 and a dust cap 41 needs to be small if a speaker is intended to be compatible with full-range sounds. So, the voice coil 35 is naturally required to be light in weight.

For reducing the weight of a voice coil 35 while keeping the DC resistance constant, the voice coil wire is required to be small in the diameter and short in length. Consequently, the diameter of voice coil 35 becomes small in the full-range speakers.

The voice coil 35 is disposed in the magnetic gap "a", and generates a driving force in accordance with electric signals, which force is conveyed to the diaphragm 37 via the voice coil bobbin 36. In an inner magnet type full-range speaker using a high-efficiency magnetic circuit, the diameter of magnet 32 is smaller than that of voice coil 35. A magnet 32 of small diameter can deliver only a small amount of magnetic flux to the magnetic gap "a", which results in a smaller driving force produced by the voice coil 35. Namely, in the conventional inner magnetic speakers, the efficiency has been low, and they are unable to produce sufficiently great sounds.

On the other hand, in order to provide a sufficiently high driving force, the diameter of magnet 32 may be increased; but this results in a deteriorated efficiency. As the weight increases, so do the volume and the cost. If it is intended to increase the driving force by making the wire of voice coil 35 thicker and longer, there is the problem of increased weight with the voice coil 35. Thus it has been difficult to implement a full-range speaker of sufficiently high efficiency using a compact and light magnetic circuit.

The Japanese Patent Laid-open Publication No. H7-23498 discloses a speaker having an improved magnetic circuit, in which a center plate is sandwiched between two magnet pieces that magnetically repulse each other, in order to provide the magnetic gap with an increased density of magnetic flux. The assembly operation of the improved magnet circuit is conducted by unitizing the two magnet pieces already magnetized and repulsive to each other. So, inner diameters of the two magnet pieces and the hole provided in a center plate are made to be equal, and exclusive assembly jigs are used for manufacturing the speakers.

In the above-described improved magnetic circuit, however, the operating point of a magnet disposed on the top plate is low and the efficiency as a whole is reduced, because the two magnet pieces are made to have equal diameters, thicknesses and the like so that they are compatible with the assembly jigs. Furthermore, since the magnet is provided with a hole, the magnetic volume is decreased accordingly. Besides, exclusive jigs are needed for assembling a magnetic circuit, which leads to a complexity of the manufacturing process.

The present invention addresses the aforementioned drawbacks of the conventional speakers, and aims to provide a compact and light-weight full-range speaker that has a sufficiently high efficiency and can be assembled with ease during its production process. The present invention also provides a magnetic circuit for the speakers.

SUMMARY OF THE INVENTION

A speaker of the present invention comprises a magnetic circuit comprising a center plate, a first magnet and a second magnet disposed, respectively, on a lower surface and an upper surface of the center plate, the first magnet and the second magnet being magnetized so that they are magnetically repulsive to each other; an under plate disposed under the first magnet, and a yoke which forms a magnetic gap in relation to the outer circumferential surface of the center plate.

The speaker further comprises a voice coil bobbin having a coil kept in the magnetic gap, a diaphragm connected to the voice coil bobbin, an edge coupled with an outer circumferential edge of the diaphragm, and a frame.

The above magnetic circuit further comprises a top plate disposed on the upper surface of the second magnet. Both the second magnet and the top plate have a ring shape, an inner and an outer diameter of the two items being substantially the same. The outer diameter of the second magnet and the top plate is smaller than that of the center plate, and the center plate is provided with a protrusion on the upper surface for a positioning of the second magnet.

A clearance (i.e. play) may be provided between the protrusion and the second magnet at their contacting surfaces. The clearance is set so that the second magnet always stays within the region of the upper surface of the center plate even when a second magnet is disposed at a maximum eccentricity with respect to the center plate.

A speaker in another embodiment of the present invention comprises a center plate, a first magnet and an under plate, which are joined by a mechanical device such as a rivet, a bolt or the like to form a unitized member. The center plate and the under plate are provided respectively with a hole of substantially the same diameter (first diameter), and the first diameter is smaller than a hole diameter (second diameter)

of the first magnet. The between the first diameter and the second diameter is determined so that the first magnet always stays within the region of the lower surface of the center plate, even when the first magnet is disposed at a maximum eccentricity with respect to the center plate.

BRIEF DESCRIPTION OF THE DRAWINGS

FIG. 2(*b*) is a cross sectional half view showing a magnetic circuit of the speaker in another modified form of the first embodiment.

FIG. 3(*b*) is the cross sectional view of the magnetic circuit of the speaker in accordance with the second exemplary embodiment.

FIG. 6 is a cross sectional view of a conventional speaker.

DETAILED DESCRIPTION OF THE INVENTION

Exemplary embodiments of the present invention are described referring to the FIG. 1 through FIG. 5.

First Embodiment

Figure 1:
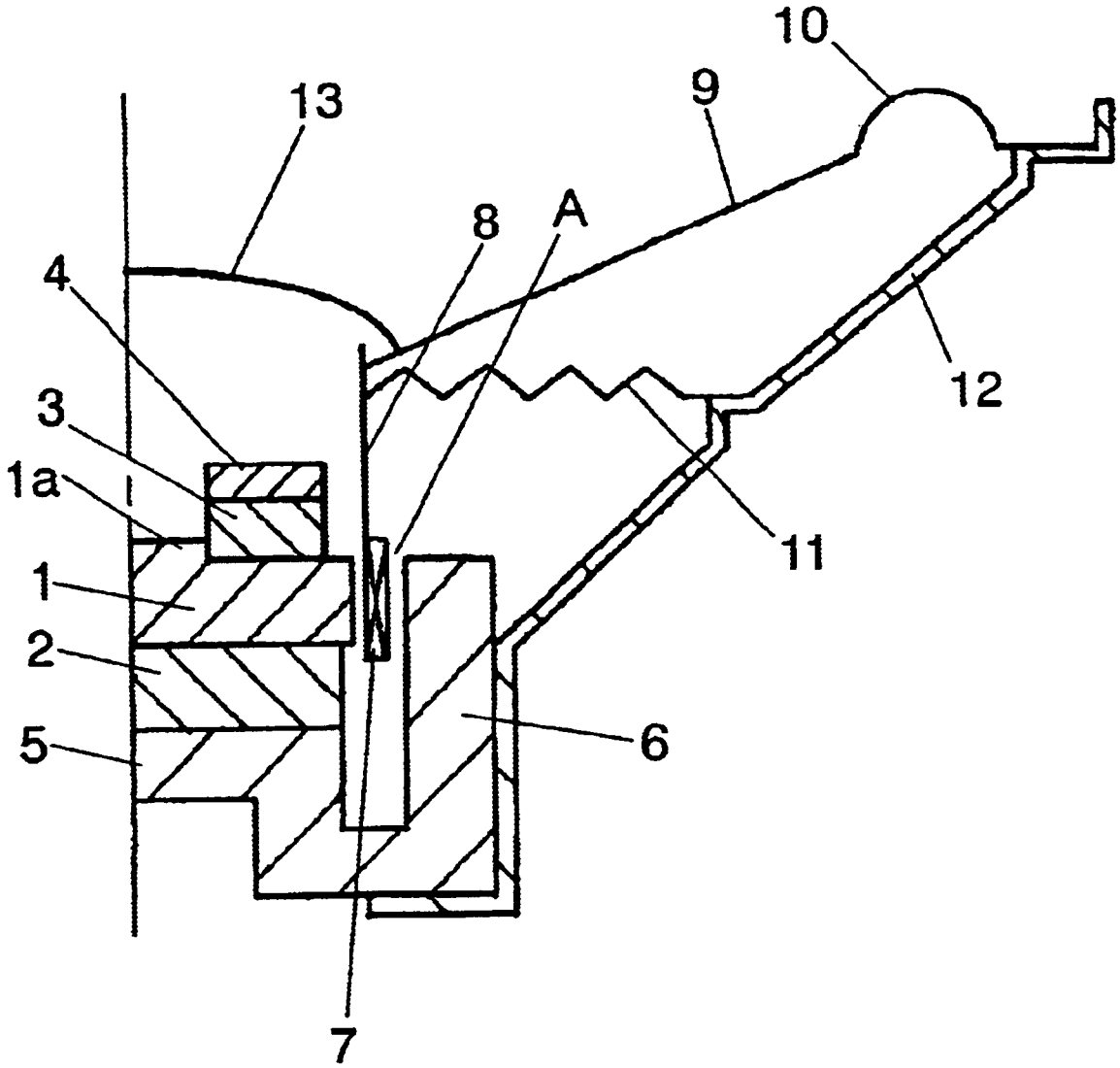
FIG. 1 is a cross sectional half view showing a speaker in accordance with a first exemplary embodiment of the present invention.
Figure 2A:
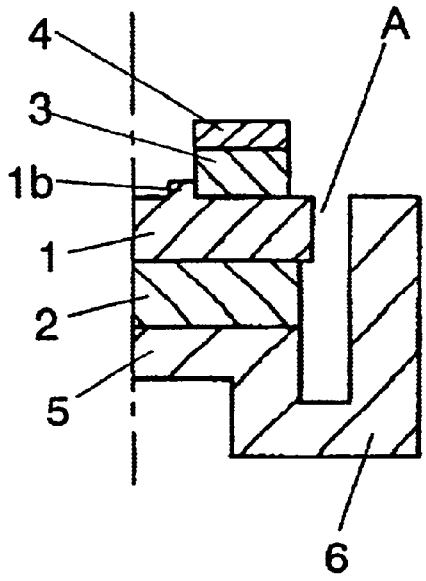
FIG. 2(*a*) is a cross sectional half view showing a magnetic circuit of the speaker in a modified form of the first embodiment.
Figure 2B:
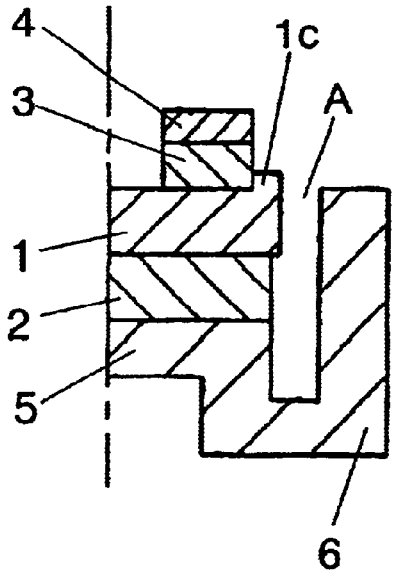

FIG. 1 shows a cross sectional half view of a speaker made in accordance with a first exemplary embodiment of the present invention. FIG. 2(*a*) and FIG. 2(*b*) show cross sectional half views of key portions of magnetic circuits of modified forms of the present embodiment.

The speaker in the present embodiment comprises a center plate 1 having a protrusion 1*a* on an upper surface, a first magnet 2 attached to a lower surface of the center plate 1 and magnetized in a direction of thickness, a ring-shaped second magnet 3 attached to the upper surface of the center plate 1 and magnetized in a reverse direction to that of the first magnet 2, a top plate 4 attached on the second magnet 3, an under plate 5 attached to a lower surface of the first magnet 2, a yoke 6 which is connected to a circumferential surface of the under plate 5 or integrally formed as a part of the under plate 5, a voice coil bobbin 8 having a coil 7 wound at a bottom portion, a frame 12 coupled with the yoke 6, a damper 11 connected at an outer circumference with the frame 12 and at an inner circumference with the voice coil bobbin 8 for supporting the voice coil bobbin 8, a diaphragm 9 adhered at an outer circumference with the frame 12 via edge part 10 while at an inner circumference with the voice coil bobbin 8, and a dust cap 13.

Now in the following, the structure as well as the operation of the speaker are described in detail.

In the first place, the magnetic circuit is described.

Magnetic flux radiated from first magnet 2 flows into the lower surface of center plate 1, passes through a magnetic gap A formed by the outer circumferential surface of center plate 1 and the inner circumferential surface of yoke 6 and returns to magnet 2 via yoke 6 and under plate 5. Meanwhile, magnetic flux radiated from the second magnet 3 flows into the upper surface of center plate 1, and most of the magnetic flux passes through the magnetic gap A to return to magnet 3 via yoke 6 and top plate 4.

Thus in the structure of the present embodiment, where the first magnet 2 and the second magnet 3 are magnetized to be repulsive to each other and are disposed in proximity to the magnetic gap A, most of the magnetic flux radiated from the magnet 2 and the magnet 3 passes through the magnetic gap A. Thus a high efficiency magnetic circuit is implemented in accordance with the present embodiment.

In the above-described structure, since the larger clearance between the yoke 6 and the top plate 4 increases the magnetic resistance of magnet 3, magnetic flux density at the operating point of magnet 3 decreases as compared with that of the magnet 2. Namely, a state of low permeance coefficient is created. As a general rule, the operating point of a magnet lowers along with an increasing magnetic resistance of the magnetic circuit, and also lowers when a thickness in the magnetization direction is small.

However, in the structure of the present embodiment where a magnet 3 is ring-shaped and the thickness in the magnetization direction has been made large, the operating point of magnet 3 can be made high. In addition, a ring-shape top plate 4 makes the magnetic flux density within magnet 3 homogeneous, which contributes to stabilization of the operating point.

When a speaker is in operation, especially when operating with high inputs, temperatures of the magnet 2 and the magnet 3 increase due to generation of heat in the coil 7. In a case where a high energy Nd—Fe—B system magnet is used for making a magnetic circuit compact, the low operating point brings about a problem of high-temperature demagnetization. However, in the present embodiment, where the ring-shaped magnet 3 and the top plate 4 are used, the operating point of the magnet 3 is stable, and the high-temperature demagnetization can be suppressed.

The driving force of voice coil bobbin 8 is generated in accordance with audio signals delivered to coil 7. The driving force becomes greater when the magnetic flux density at the magnetic gap A is higher, and the wire length of the coil 7 is longer.

In a full-range speaker which covers the sounds of an entire audible range, it is desired that the vibration system be light in weight. It is also desired that the coil 7, formed of a metal having a high specific gravity, be light in weight. This naturally leads to a small coil 7 made of a thin and short wire for meeting a certain specific DC resistance.

The coil 7 is supported in the magnetic gap A, which means that the diameter of the magnet 2 is smaller than that of the coil 7. In the present embodiment, however, a sufficiently high magnetic flux density is provided at the magnetic gap A because of the magnet 3 which has been magnetized to be repulsive to the magnet 2. Therefore, a speaker in the present embodiment can be a full-range speaker that has a sufficiently high driving force, despite the compact-sized magnetic circuit.

Now, the function of the protrusion 1*a* provided on the center plate 1 will be described.

When a magnet 3 is adhered on the center plate 1, the bonding strength may not be very high because it has a relatively small area of adhesion with the ring-shaped magnet 3. But the possibility of separation in the vertical direction is very small since a magnetic attractive force exists between the upper surface of center plate 1 and the lower surface of magnet 3. Therefore, what is important for ensuring high functional reliability of the speaker is to prevent sidewise displacement of the magnet 3, in order to avoid a collision of the magnet 3 with the coil 7 or the voice coil bobbin 8.

In a speaker of the present embodiment, the protrusion 1*a* provided at the center of center plate 1 is designed to engage the magnet 3. The protrusion 1*a* prevents the magnet 3 from moving sidewise, hence it contributes to improved reliability. In addition, the protrusion 1*a* also serves as a guide for easily assembling the magnet 3 into a magnetic circuit. Besides, the protrusion 1*a* may also be used as a guide for assembling the top plate 4, so long as an adverse influence of the protrusion 1*a* to the magnetic resistance, which will be referred to later, remains negligible.

In order to make assembly of center plate 1 and second magnet 3 still easier, a small clearance may be provided between an outer diameter of protrusion 1*a* and an inner diameter of magnet 3 to provide for easier mutual engagement. The clearance allows the magnet 3 to be located somewhat eccentrically. The mutual dimensional allowances relating to the clearance should be set so that the bottom surface of magnet 3 always stays within a region above the upper surface of center plate 1. By so designing the components, the magnet 3 will never get into the magnetic gap A to disturb a free vibration of coil 7 and voice coil 8.

Likewise, the top plate 4 is disposed in a position so as to not disturb the vibration of coil 7 or voice coil 8. Magnetic resistance with the yoke 6 can be minimized and the magnetic flux density of the magnetic circuit can be maximized to a higher efficiency, by making the size of top plate 4 as large as possible.

Furthermore, it is preferred to make the height of the protrusion 1*a* relatively low so as to make the magnetic resistance between the upper part of magnet 3 and the protrusion 1*a* of center plate 1 high, in order not to increase the amount of magnetic flux radiated from the protrusion 1*a*.

Although FIG. 1 illustrates the protrusion 1*a* in a simple disk form provided at the center, the shape of protrusion 1*a* is not so limited. As an example of other developments in the shape, FIG. 2(*a*) shows a cross sectional view of a ring-shaped protrusion 1*b* provided on the center plate 1, and FIG. 2(*b*) shows a ring-shaped protrusion 1*c* provided along the outer circumference of center plate 1. Thus the protrusion 1*a* may engage with the magnet 3 at the outer circumferential edge of the magnet 3.

FIG. 1 simply exemplifies a general structure of a speaker having a diaphragm 9, an edge part 10, a damper 11, a frame 12 and a dust cap 13. Application of the present invention is not limited to the speakers of the above-described configuration. For example, the damper 11 may be eliminated from the speaker if the voice coil or the diaphragm is supported by other appropriate supporting means.

Second Embodiment

Figure 3A:
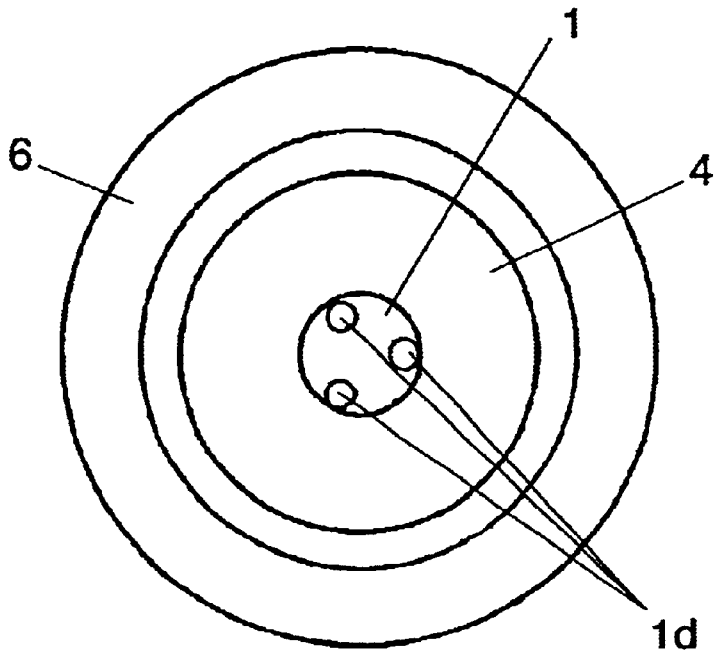
FIG. 3(*a*) is a top view of a magnetic circuit of a speaker in accordance with a second exemplary embodiment.
Figure 3B:
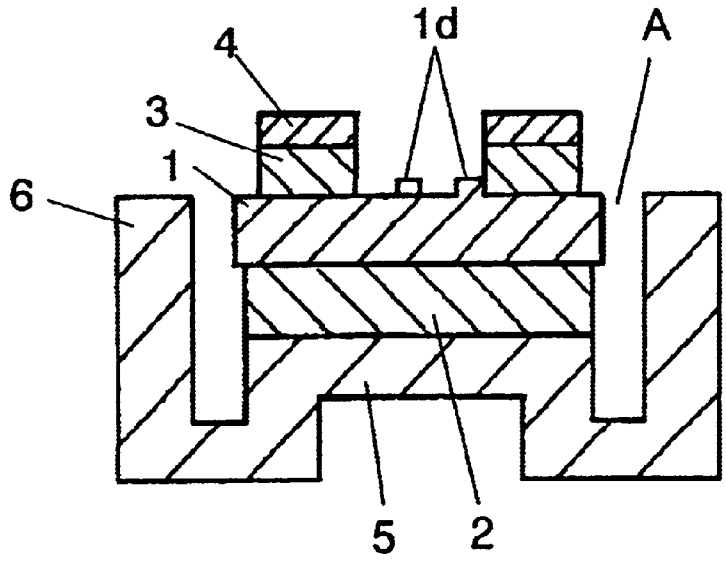

FIG. 3(*a*) is a top view of a key portion of a magnetic circuit of a speaker in accordance with a second exemplary embodiment of the present invention. FIG. 3(*b*) is a cross sectional view of the magnetic circuit. Portions identical to those of the first embodiment are represented by using the same reference numerals, and a description of these portions is eliminated.

This second embodiment differs from the first embodiment with respect to the protrusion provided on the center plate 1. In the second embodiment, a plurality of protrusion parts 1*d* are provided so that they have contact with the inner circumferential surface of the ring-shaped second magnet 3.

Since the protrusion parts 1*d* in the present embodiment are provided on the upper surface of center plate 1 at plural points, the gross area of top surface of the protrusion parts 1*d* can be made smaller than that in the first embodiment. Therefore, the magnetic resistance between the top surface of protrusion parts id and magnet 3 can be made greater to suppress the amount of magnetic flux escaping therefrom. In this way the amount of magnetic flux radiated to the magnetic gap A can be increased to provide a higher efficiency magnetic circuit.

Although FIG. 3(*a*) illustrates three protrusion parts 1*d* disposed in a ring arrangement, the number of protrusion parts 1*d* and the layout arrangement are not limited to what is illustrated. FIG. 3(*a*) illustrates only an example.

Although, in the present embodiment, the protrusion parts 1*d* have been described to be making contact with the inner circumference of magnet 3, it is allowed, like in the first embodiment, for magnet 3 to have a slight positioning eccentricity in so far as it does not disturb the free vibration of coil 7 and voice coil 8. Namely, some dimensional clearance between the protrusion parts 1*d* and magnet 3 may be provided to allow for easier and efficient assembly.

Third Embodiment

Figure 4:
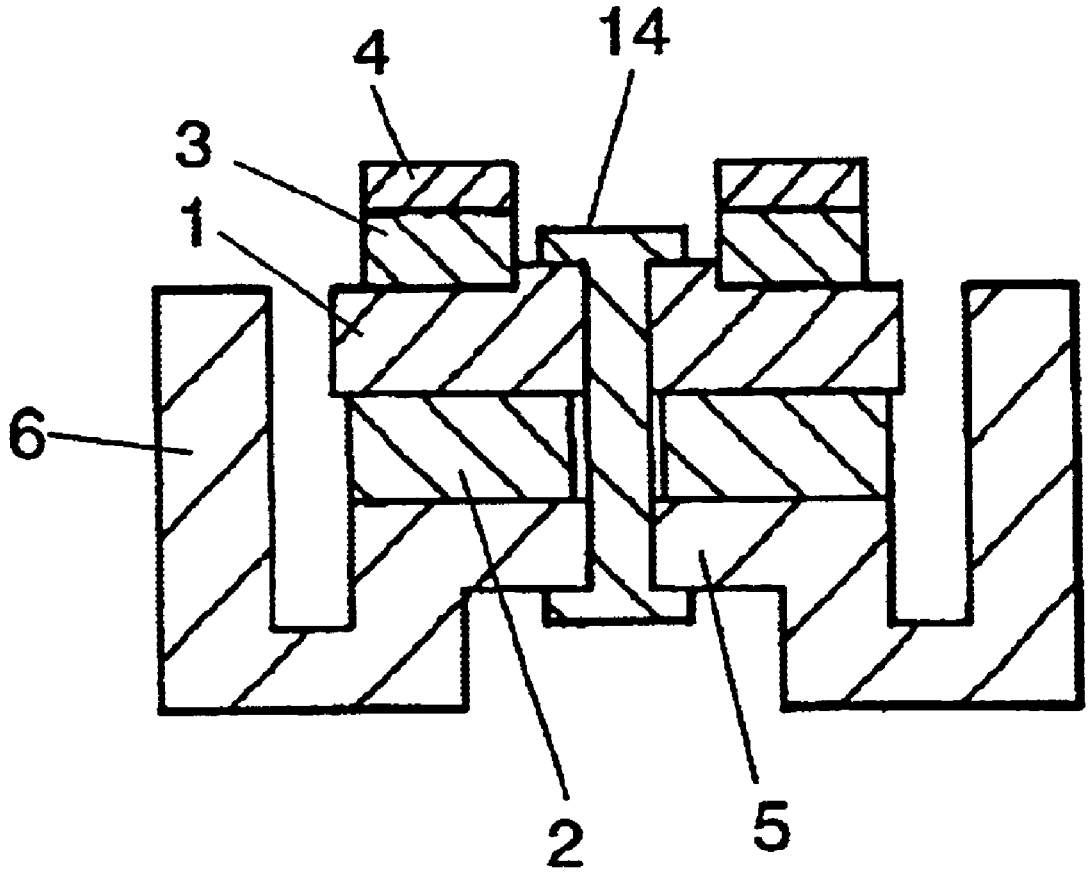
FIG. 4 is a cross sectional view showing a magnetic circuit of a speaker in accordance with a third exemplary embodiment of the present invention.

FIG. 4 is a cross sectional view showing a magnetic circuit of a speaker in accordance with a third exemplary embodiment of the present invention.

A difference from the first embodiment 1 is that each of an under plate 5, a magnet 2 and a center plate 1 is provided at a center with a hole for receiving a rivet 14.

A magnetic circuit in the present embodiment is formed with the center plate 1, the magnet 2 and the under plate 5 having holes at their respective centers and being attached and fixed tightly together by a rod-shaped, or a cylindrical, non-magnetic rivet 14 penetrating from the bottom of the under plate 5 to the upper surface of the center plate 1, followed by a caulking (i.e. deformation) of the end of the rivet.

Since the outer circumferential surface of center plate 1 and the inner circumferential surface of yoke 1 form a magnetic gap A, there is a substantial force of magnetic attraction working in the gap A. In the popularly practiced conventional assembly procedure, a magnet 2 attached to an under plate 5 and a center plate 1 attached to the magnet 2 are fixed together with an adhesive material. The adhesive strength of the adhesive materials deteriorates at high temperatures. Since a compact magnetic circuit has only a small thermal capacity, its temperature becomes high while the speaker is in operation. This might degrade adhesion reliability. In the present embodiment, however, these constituent members are combined together by the rivet 14, so the connecting reliability is improved.

The adhesive material can be eliminated when the center plate 1, the magnet 2 and the under plate 5 are joined together by the rivet 14. The elimination of adhesive material reduces the magnetic resistance in the magnetic circuit formed by the magnet 2, the center plate 1, the magnetic gap A, the yoke 6 and the under plate 5. As a result, the magnetic flux in the magnetic gap A increases.

In a practical method of assembling the magnet circuit of the speaker, the center plate 1, the magnet 2, the under plate 5 and the yoke 6 are joined together and the magnet 2 is magnetized. On the other hand, the second magnet 3 and the top plate 4 are joined together and the magnet 3 is magnetized. And, then the two component blocks thus formed are connected together to form the magnetic circuit. Taking the above practice into consideration, it is an efficient procedure to join the center plate 1, the magnet 2 and the under plate 5 together using the rivet 14; not joining the entire components of a magnetic circuit at once.

The rivet 14 shown in the drawing is an example, and a shape of the rivet is not intended to be limited to what is illustrated. For example, the rivet 14 may have a tubular structure, or a solid bolt may be used for the rivet 14.

Diameters of the holes in center plate 1 and under plate 5 may be made substantially equal, while the diameter of the hole in magnet 2 may be made slightly greater than those of the holes in the center plate 1 and the under plate 5, in so far as a distance formed between the outer circumferential surface of magnet 2 and the inner surface of yoke 6 is maintained to be greater than the width of magnetic gap A even when the eccentricity of magnet 2 due to the diameter difference between the rivet 14 and the hole of the first magnet 2 is at its maximum. By so setting the dimensions, grinding and polishing of the hole of the magnet 2 can be eliminated to reduce the production cost. Namely, a grinding and polishing procedure is generally indispensable when a high-energy Nd—Fe—B system sintered magnet is used in a place where high dimensional accuracy is required. However, if the first magnet 2 is provided in advance with a hole of a slightly greater diameter in accordance with the above described arrangements so that the rivet 14 can go through the hole, the post polishing process for the hole of the first magnet 2 can be eliminated. This leads to a lower manufacturing cost for the magnet 2.

Furthermore, by providing the magnet 2 with a hole whose diameter is greater than those of the holes in center plate 1 and under plate 5, strict accuracy of placing the magnet 2 is not required, and the rivet 14 can be inserted through the hole with ease.

Fourth Embodiment

Figure 5:
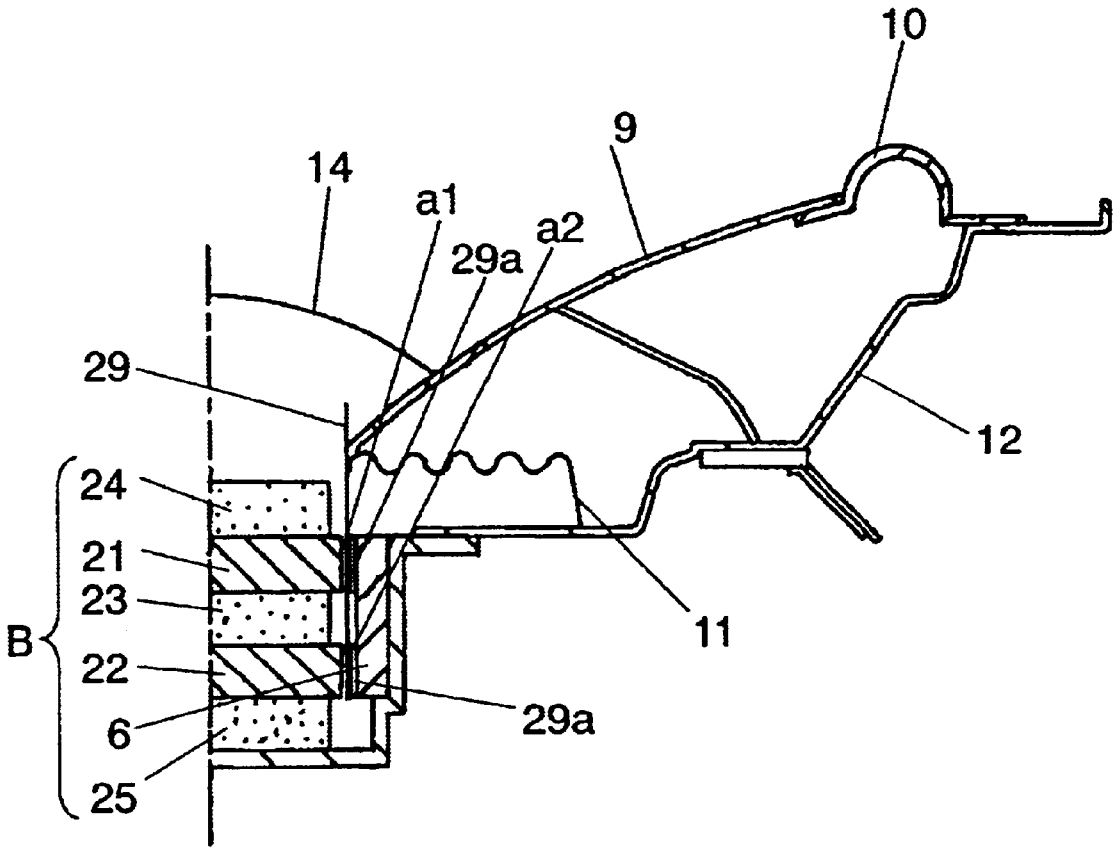
FIG. 5 is a cross sectional half view showing a magnet circuit of a speaker in accordance with a fourth exemplary embodiment of the present invention.

FIG. 5 is a cross sectional half view of a magnetic circuit of a speaker in accordance with a fourth exemplary embodiment of the present invention.

The present embodiment employs a magnetic circuit B shown in FIG. 5.

The magnetic circuit B is formed of a first magnet 23 attached to a lower surface of a first plate 21, a second magnet 24 disposed on another surface of the first plate 21 and magnetized in a direction repulsive to the first magnet 23, and a third magnet 25 disposed on a lower surface of a second plate 22 and magnetized in a direction repulsive to the first magnet 23.

In a configuration of the present embodiment, magnetic flux radiated from the first magnet 23 flows into the first plate 21 and passes through a first magnetic gap al formed by an outer circumferential surface of plate 21 and an inner circumferential surface of yoke 6. Then, it passes through the yoke 6 to a second magnetic gap a2 formed by the inner circumferential surface of yoke 6 and an outer circumferential surface of second plate 22 and returns to magnet 23 via an upper surface of plate 22.

Magnetic flux radiated from the second magnet 24 flows into the plate 21, passes through the magnetic gap al and returns to the magnet 24 via yoke 6.

Magnetic flux radiated from the third magnet 25 passes through the magnetic gap a2 via yoke 6, flows into the plate 22 and returns to the magnet 25.

The magnet 23 and the magnet 24 are magnetically repulsive to each other, and the magnet 23 and the magnet 25 are magnetically repulsive to each other. The magnet 24 is disposed close to the plate 21 while the magnet 25 is disposed close to the plate 22, and both of the magnets 24 and 25 are disposed in proximity to the respective magnetic gaps a1 and a2. Therefore, most of the magnetic flux radiated from the magnet 23, the magnet 24 and the magnet 25 are concentrated to the magnetic gaps a1 and a2. Thus a high efficiency magnetic circuit for a speaker is implemented in accordance with the present embodiment.

As described above, the magnet 24 and the magnet 25 magnetized to be repulsive to each other ensure a sufficiently high magnetic flux density in the magnetic gaps. Therefore, even a compact magnetic circuit provides a sufficiently high driving force, which provides a compact full-range speaker.

The driving forces generated at coils 29*a* disposed in the magnetic gaps a1, a2 is conveyed via the voice coil bobbin 29 to the diaphragm 9, which vibrates and radiates sound waves.

If the plate 21 and the plate 22 are made to be substantially identical with respect to their shapes, dimensions and material, and the magnet 24 and the magnet 25 are made so their diameters are smaller than at least the diameter of the magnet 23, the magnetic flux density at the magnetic gaps a1 and a2 can be made equal. So, the driving forces generated at the coils 29*a* in the magnetic gaps can be made to be the same. Under the above-described configuration, distribution of the magnetic flux density and the driving force can be made symmetrical in the vibrating direction of coils 29*a*. In this way, asymmetric distortion in the up/down amplitude due to a magnetic factor can be suppressed.

In the magnetic circuit, since the magnet 23 has a smaller magnetic resistance, as viewed from the magnets, compared with the magnet 24 and the magnet 25, the magnet 23*a* provides a great portion of the magnetic flux to the magnetic gaps a1, a2. Therefore, the overall rate of magnet utilization can be increased by keeping the diameters of magnets 24, 25 equal to that of the magnet 23. In other words, the overall rate of utilization can be increased by increasing the diameter of magnet 23 as much as possible.

The magnet 23, the magnet 24 and the magnet 25 attached to the plate 21 and the plate 22 are conventionally joined with the yoke 6 using adhesives. However, these members may be joined instead by means of a rivet without using an adhesive, as described in the third embodiment.

INDUSTRIAL APPLICABILITY

As described in the foregoing, a sufficient amount of magnetic flux can be provided in accordance with the present invention to a magnetic gap of a magnetic circuit of a speaker. The present invention provides a compact, highly efficient and reliable magnetic circuit that can be manufactured through an easy manufacturing process. Using the magnetic circuit, a speaker can reproduce sufficiently high sound levels covering the whole audible sound range.

What is claimed is:

1. A loudspeaker comprising:

a frame;

a magnetic circuit supported by said frame and comprising a first magnet, a second magnet disposed in opposing relation to said first magnet, said first magnet and said second magnet being magnetized to be magnetically repulsive to each other, a first plate disposed between said first and second magnets, a second plate disposed on a side of said first magnet opposite said first plate, and a yoke disposed in opposing relation to an outer circumferential surface of said first plate, such that a magnetic gap is defined between said yoke and said outer circumferential surface of said first plate;

a voice coil bobbin having a coil kept in said magnetic gap;

a diaphragm connected to said voice coil bobbin; and an edge part coupled with an outer circumferential edge of said diaphragm;

wherein said magnetic circuit further comprises a third plate disposed on a side of said second magnet opposite said first plate, each of said second magnet and said third plate having a ring shape, said second magnet and said top plate having substantially equal inner diameters and substantially equal outer diameters, said outer diameters of said second magnet and said third plate being smaller than an outer diameter of said first plate; and wherein a protrusion projects from said first plate in a direction away from said first magnet for positioning of said second magnet.

2. The loudspeaker of claim 1, wherein play is provided between said protrusion and said second magnet, an amount of said play being set so that an outer circumferential surface of said second magnet always stays within an outer circumference of said first plate even when said second magnet is at a maximum eccentricity with respect to said first plate.

3. The loudspeaker of claim 1, wherein said protrusion has one of a disk shape and a ring shape.

4. The loudspeaker of claim 1, wherein said protrusion comprises a plurality of protrusion parts disposed concentrically with respect to said first plate.

5. The loudspeaker of claim 1, wherein said first plate, said first magnet and said second plate are unitized by a mechanical fastener.

6. The loudspeaker of claim 5, wherein said mechanical fastener is one of a rivet and a bolt.

7. The loudspeaker of claim 5, wherein said first plate, said first magnet and said second plate have holes therethrough for receiving said mechanical fastener, said holes of said first and second plates having substantially equal first diameters, said hole of said first magnet having a second diameter larger than said first diameters, and a difference between said first and second diameters being set so that an outer circumference of said first magnet always stays within an outer circumference of said first plate even when said first magnet is disposed at a maximum eccentricity with respect to said first plate.

8. The loudspeaker of claim 1, wherein each of said first magnet, said second magnet, said first plate, said second plate and said third plate has first and second opposite surfaces;

said first surface of said third plate is disposed on said second surface of said second magnet;

said first surface of said second magnet is disposed on said second surface of said first plate;

said first surface of said first plate is disposed on said second surface of said first magnet;

and said first surface of said first magnet is disposed on said second surface of said second plate.

9. The loudspeaker of claim 1, wherein said yoke is supported at an outer circumferential part of said second plate.

10. A loudspeaker comprising:

a frame;

a magnetic circuit supported by said frame and comprising a first plate, a second plate disposed in opposing relation to said first plate, a first magnet disposed between said first and second plates, a cylindrical yoke having an inner surface disposed in opposing relation to outer circumferential surfaces of said first and second plates, respectively, such that a first magnetic gap is defined between said inner surface of said yoke and said outer circumferential surface of said first plate, and such that a second magnetic gap is defined between said inner surface of said yoke and said outer circumferential surface of said second plate, a second magnet disposed on a side of said first plate opposite said first magnet, said second magnet being magnetized to be repulsive to said first magnet, and a third magnet disposed on a side of said second plate opposite said first magnet, said third magnet being magnetized to be repulsive to said first magnet;

a voice coil bobbin having coils kept in said first and second magnetic gaps;

a diaphragm connected to said voice coil bobbin; and an edge part coupled with an outer circumferential edge of said diaphragm.

11. The loudspeaker of claim 10, wherein said first plate and said second plate are made of substantially a same material and have substantially a same shape, said second magnet and said third magnet are made of substantially a same material and have substantially a same shape, and said second magnet and said third magnet have diameters smaller than a diameter of said first magnet.

12. The load speaker of claim 10, wherein each of said first magnet, said second magnet, said third magnet, said first plate and said second plate has first and second opposite surfaces;

said first surface of said second magnet is fixed on said second surface of said first plate;

said first surface of said first plate is fixed on said second surface of said first magnet;

said first surface of said first magnet is fixed on said second surface of said second plate;

and said first surface of said second plate is fixed on said second surface of said third magnet.

13. A magnetic circuit for a loudspeaker comprising;

a first plate;

a second plate disposed in opposing relation to said first plate;

a first magnet disposed between said first and second plates;

a cylindrical yoke having an inner surface disposed in opposing relation to outer circumferential surfaces of said first and second plates, respectively, such that a first magnetic gap is defined between said inner surface of said yoke and said outer circumferential surface of said first plate, and such that a second magnetic gap is defined between said inner surface of said yoke and said outer circumferential surface of said second plate;

a second magnet disposed on a side of said first plate opposite said first magnet, said third magnet being magnetized to be repulsive to said first magnet; and a third magnet disposed on a side of said second plate opposite said first magnet, said third magnet being magnetized to be repulsive to said first magnet.

14. The magnetic circuit of claim 13, wherein said first plate and said second plate are made of substantially a same material and have substantially a same shape, said second magnet and said third magnet are made of substantially a same material and have substantially a same shape, and said second magnet and said third magnet have diameters smaller than a diameter of said first magnet.

15. The magnetic circuit of claim 13, wherein each of said first magnet, said second magnet, said third magnet, said first plate and said second plate has first and second opposite surfaces;

said first surface of said second magnet is fixed on said second surface of said first plate;

said first surface of said first plate is fixed on said second surface of said first magnet;

said first surface of said first magnet is fixed on said second surface of said second plate;

and said first surface of said second plate is fixed on said second surface of said third magnet.

* * * * *

UNITED STATES PATENT AND TRADEMARK OFFICE

CERTIFICATE OF CORRECTION

PATENT NO. : 6,671,385 B2
DATED : December 30, 2003
INVENTOR(S) : Takashi Suzuki et al.

It is certified that error appears in the above-identified patent and that said Letters Patent is hereby corrected as shown below:

Title page,
Item [30], please insert the following:

-- Foreign Application Priority Data

August 24, 2000 (JP) ……..2000-253730
September 5, 2000 (JP) ……..2000-268254 --

Signed and Sealed this

Twenty-fifth Day of May, 2004

JON W. DUDAS
*Acting Director of the United States Patent and Trademark Office*